US006631932B2

(12) United States Patent
Kunst et al.

(10) Patent No.: US 6,631,932 B2
(45) Date of Patent: Oct. 14, 2003

(54) MOTOR VEHICLE DOOR LOCK WITH ELASTICALLY DEFLECTABLE COUPLING ELEMENT

(75) Inventors: Frank Kunst, Olfen (DE); Norbert Frohne-Brinkmann, Heiligenhaus (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/825,359

(22) Filed: Apr. 4, 2001

(65) Prior Publication Data

US 2001/0030428 A1 Oct. 18, 2001

(30) Foreign Application Priority Data

Apr. 4, 2000 (DE) ..... 100 16 632

(51) Int. Cl.[7] ..... E05C 3/06
(52) U.S. Cl. ..... 292/201; 292/DIG. 23
(58) Field of Search ..... 292/201, 216, 292/DIG. 23

(56) References Cited

U.S. PATENT DOCUMENTS 5,106,135 A * 4/1992 Menke et al. ..... 292/216
5,494,322 A * 2/1996 Menke ..... 292/201
5,584,515 A * 12/1996 Silye ..... 292/201
5,802,894 A * 9/1998 Jahrsetz et al. ..... 292/144
6,000,257 A * 12/1999 Thomas ..... 292/201
6,003,910 A * 12/1999 Dupont et al. ..... 292/201
6,007,118 A * 12/1999 Arabia et al. ..... 292/216
6,113,161 A * 9/2000 Jung et al. ..... 292/216
6,328,353 B1 * 12/2001 Barczynski et al. ..... 292/216

FOREIGN PATENT DOCUMENTS

DE 43 13 248 C2 11/1994
DE 195 12 573 A1 10/1996

* cited by examiner

*Primary Examiner*—William L. Miller
*Assistant Examiner*—Thomas Ho
(74) *Attorney, Agent, or Firm*—Nixon Peabody LLP; David S. Safran

(57) ABSTRACT

A motor vehicle door lock with a lock mechanism including actuation mechanism which is manually-actuated to actuate a trigger mechanism to a coupled position via a coupling mechanism. A coupling element is engaged by a displacement mechanism which is manually or electronically actuated from the coupled position into an uncoupled position and vice versa when the actuation mechanism is not actuated. When the coupling element is in the uncoupled state and the actuation mechanism is actuated, the coupling element is moved into an intermediate storage position by actuating an adjustment mechanism. A spring element tensions the coupling element into the storage position when the coupling element is shifted. A structural simplification is achieved with the same functionality in that the spring element is an integrated component with the coupling element.

3 Claims, 4 Drawing Sheets

MOTOR VEHICLE DOOR LOCK WITH ELASTICALLY DEFLECTABLE COUPLING ELEMENT

BACKGROUND OF THE INVENTION

1. Field of the Invention

The present invention is directed to a motor vehicle door lock with a spring-elastically deflectable coupling mechanism.

2. Description of the Prior Art

A conventional motor vehicle door lock is disclosed in German Patent Publication DE 43 13 248 A1, which includes lock mechanisms such as a lock latch, a detent pawl which blocks the lock latch in a closed position, and a lock mechanism having a plurality of mechanisms which interact with one another and which optionally actuate the lock mechanisms. The lock mechanism also includes an inside actuation lever which returns to its rest position under spring force and which can be actuated against spring force, and an inside safety lever coupled to the inside actuating lever such that actuation of the inside actuating lever with the inside safety lever in the safety position first releases the inside safety lever and afterwards lifts the detent pawl to release the lock latch.

With the inside safety lever in the safety position, the inside actuating lever is decoupled from the detent pawl. The inside actuating lever with the inside safety lever still in the safety position executes an idle stroke and moves only the inside safety lever into the released position. After release of the inside actuating lever and return of the inside actuating lever into its neutral position, the inside actuating lever is coupled to the detent pawl by means of a coupling element which engages under spring force. When the inside actuating lever is actuated again, the detent pawl is then lifted. The coupling element which effects the coupling of the inside actuating lever to the detent pawl actuator is a coupling rod which is pre-tensioned in the direction of the coupled position by spring force, but can be deflected against the spring force. The spring force is produced by a separate return spring which engages the end of the coupling rod.

Such a device has is disadvantageous since the released position is essentially stored after the inside actuating lever is actuated the first time by the coupling element reaching the storage position from which it then reaches the coupled position when the inside actuating lever is released under the action of spring force. The above explained construction results in inadvertent opening of the motor vehicle door being reliably prevented. This is called the "double stroke function." In the above explained motor vehicle door lock which forms the point of departure for the teaching, another problem of operating engineering is solved in the same way. What results specifically is that the motor vehicle door lock can also be released from the inside when at the same time opening actuation is taking place from the outside, therefore, the outside actuating lever has been pulled. What results is that release becomes possible because the released position is stored mechanically under a spring force. After the outside door handle is released again and thus the outside actuating lever is released, the corresponding coupling element under the spring force of a likewise separate spring mechanism reaches the coupled-in position from which the door is easily opened with repeated pulling on the outside door handle. This is called the "comfort function".

In addition, on the rear side doors and on the rear doors in some station wagons there is generally a child safety.

There are child safeties in various embodiments, either mechanically actuated, or also recently actuated by motor (electric motor). Recently implementing child safety devices have been provided such that the child safety actuation can only ever be actuated in the same direction against a reset spring force on the child safety lever (German Patent Publication DE 195 12 573 A1) has also become known. In this purely mechanical child safety therefore by each actuation of the child safety in the same direction the location of the child safety lever changes to the position which is the other one at the time. This two-way catching is a convenient and easy actuation possibility.

SUMMARY OF THE INVENTION

In view of the foregoing, it is an object of the present invention to overcome the aforementioned disadvantages in the prior art to provide a motor vehicle door lock having a spring-loaded storage position of the coupling mechanism, whereby the storage position precedes the coupled position.

These and other objects are achieved in a motor vehicle door lock with a spring mechanism which is an integral component of the coupling element especially in that the spring mechanism is made in the form of a spring-elastic section of the coupling mechanism. The coupling element can also be made as a spring-elastic mechanism so that it transfers force between the actuation mechanism and trigger mechanism, especially the detent pawl actuator, but also inherently executes the spring-elastic function. This saves an additional movable support of the coupling mechanism, an additional spring and the installation costs for installation of these components. The teaching of the present invention can be implemented for the "double stroke function" and also for the "comfort function" explained above.

In accordance with the present invention, it is provided that the actuation mechanism is an inside actuating lever which can be actuated by the inside door handle, the trigger mechanism is a detent pawl actuator and the displacement mechanism is a child safety lever which can be actuated by a child safety actuator and/or especially by a motorized child safety drive. In particular, in a motorized child safety drive the teaching of the present invention yields a special advantage in terms of control engineering. Specifically, the child safety can be actuated at any time without having to consider the respective position of the inside actuating lever. An additional control which allows the drive motor to be started for the motorized child safety only when the inside actuating lever has reached its base position is associated with cost in terms of control engineering, but, in addition, would also require interrogation of the position of the inside actuating lever, for example, via a microswitch. The latter is, however, expensive and can be avoided with the teaching of the present invention.

In the following, the present invention is explained in detail using drawings which show a single embodiment.

BRIEF DESCRIPTION OF THE DRAWINGS

FIG. 2 shows a motorized form of the FIG. 1 embodiment, with the inside actuating lever being actuated and the child safety turned on;

DETAILED DESCRIPTION OF THE INVENTION

Figure 1:
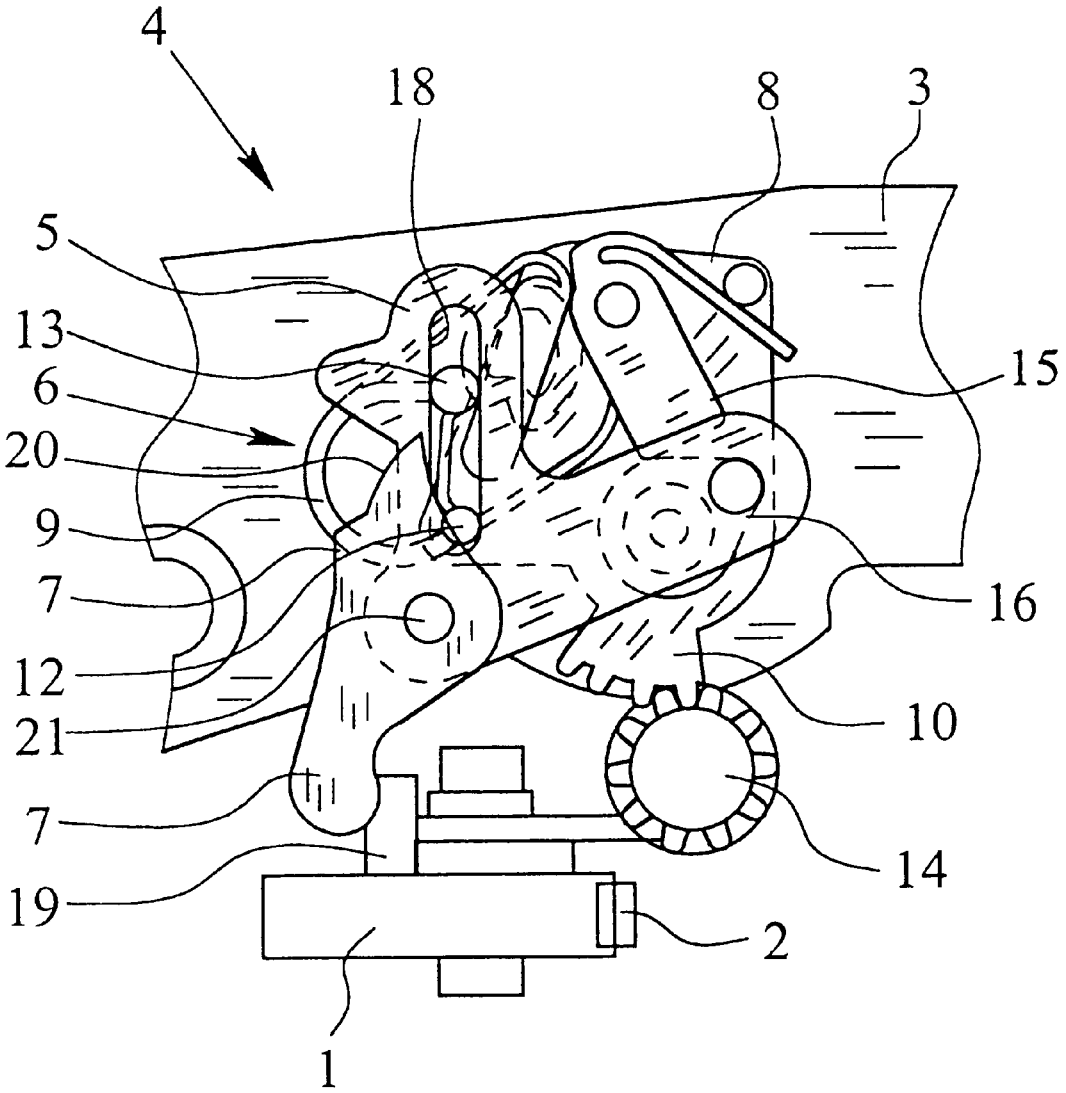
FIG. 1 is a schematic representation of an embodiment of a motor vehicle door lock having both mechanical and motorized actuation of a child safety which is turned on, with an inside actuating lever not actuated.

FIG. 1 shows a motor vehicle door lock in accordance with a preferred embodiment, including a lock latch 1, a detent pawl 2 which holds the lock latch 1 in a closed position, and a base carrier 3 for supporting the motor vehicle door lock. The motor vehicle lock also includes a lock mechanism 4 having a manually-activated actuation mechanism 5 for actuating a trigger mechanism 7 into a coupled position via a coupling element 6. The coupling element 6 is moved by a displacement mechanism 8 (which can be manually-actuated, or electronically-actuated via a motor) with the actuation mechanism 5 in a non-actuated position, from the coupled position into the uncoupled position and vice versa. In the uncoupled state and with the actuation mechanism 5 actuated, the coupling element 6 can be moved by actuating the displacement mechanism 8 into a storage position which precedes the coupled position. A spring mechanism 9 is provided to shift the coupling element 6 from the storage position into the coupled position when the actuation mechanism 5 is not actuated.

To implement a "comfort function," it can be provided that the actuation mechanism 5 is an outside actuating lever which can be actuated by the outside door handle, the trigger mechanism 7 is a detent pawl actuator and the displacement mechanism 8 is an inside safety lever which can be actuated by the inside door handle, the inside safety button and/or the central interlock drive. A "double stroke function" can also be implemented such that the actuation mechanism 5 is an inside actuating lever which can be actuated by the inside door handle, the trigger mechanism 7 is a detent pawl actuator and the displacement mechanism 8 is in turn the inside actuating lever which can be actuated by the inside door handle.

In a preferred embodiment, the actuation mechanism 5 is an inside actuating lever which is actuated by the inside door handle, the trigger mechanism 7 is a detent pawl actuator and the displacement mechanism 8 is a child safety lever which is actuated by the child safety actuator 10 and/or especially by the motorized child safety drive 11. It is preferred that the spring mechanism 9 is an integrated component of the coupling element 6. Integrated component means that the spring mechanism 9 is not a separate component which interacts with the coupling element 6, but that the spring mechanism 9 is implemented by the shaping and material selection of the coupling element 6. The preferred embodiment shows that the spring mechanism 9 is formed by the spring-elastic section of the coupling element 6.

As shown in FIG. 1, the coupling element 6 is made as a spring lever, preferably of plastic, with a fixed coupling point 12 and a coupling pin 13 or the like positioned a distance proximal to the coupling point 12, the coupling pin 13 being biased away from the coupling point 12, and interacting with the trigger mechanism 7 in the coupled position. The spring mechanism 9 is formed by the section of the coupling element 6 between the fixed coupling point 12 and the coupling pin 13. The spring characteristic can be determined by the dimensioning and selection of the material of this section. In this embodiment, the section of the coupling element 6 is preferably made of plastic, or alternatively, reinforced by fibers or other additives.

Figure 2:
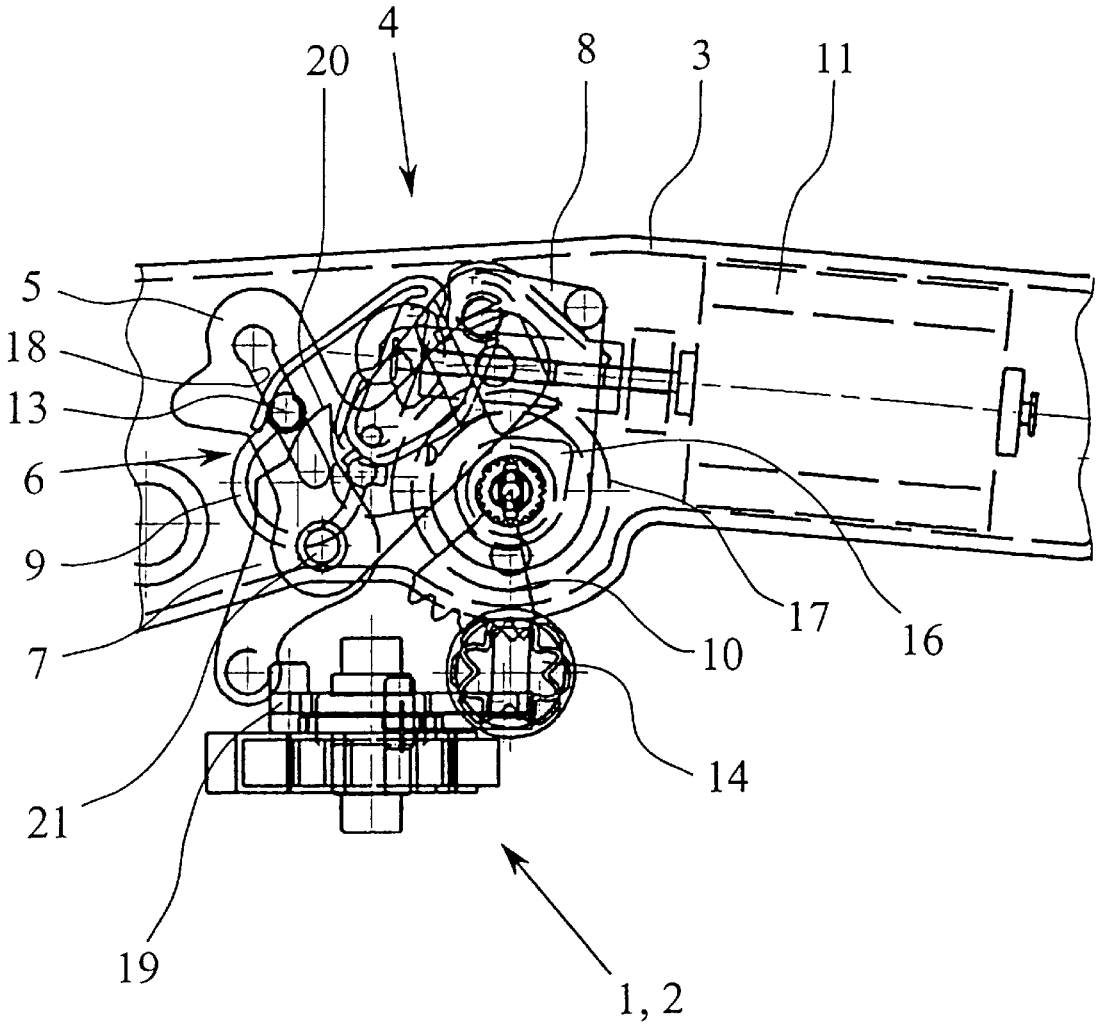

FIG. 1 further shows an embodiment in which a child safety lever which forms the displacement mechanism 8 can be actuated both by a mechanical child safety actuator 10 via a rotary nut 14, and also by an electric-motorized child safety drive 11 (FIG. 2). A ratchet 15 is spring loaded in one direction, and is supported on the displacement mechanism 8 and projects into the actuating path of a cam 16 on a worm wheel 17 of the child safety drive 11. The displacement mechanism 8 interacts with a cardioid-shaped slot 18 of a ballpoint pen mechanism such that, by each actuation of the displacement mechanism 8, switching from the "on" position into the "off" position or vice versa takes place. FIG. 1 shows the position of the motor vehicle door lock with the actuation mechanism 5 (the inside actuation lever) not actuated and with the coupling element 6 in the uncoupled position. The actuation mechanism 5 has an elongated hole in which the coupling pin 13 of the coupling element 6 is located such that it is free of the driving surface on the trigger mechanism 7. Disposed between the trigger mechanism 7 (the detent pawl actuator), and the detent pawl 2 is a transmission lever 19.

Figure 3:
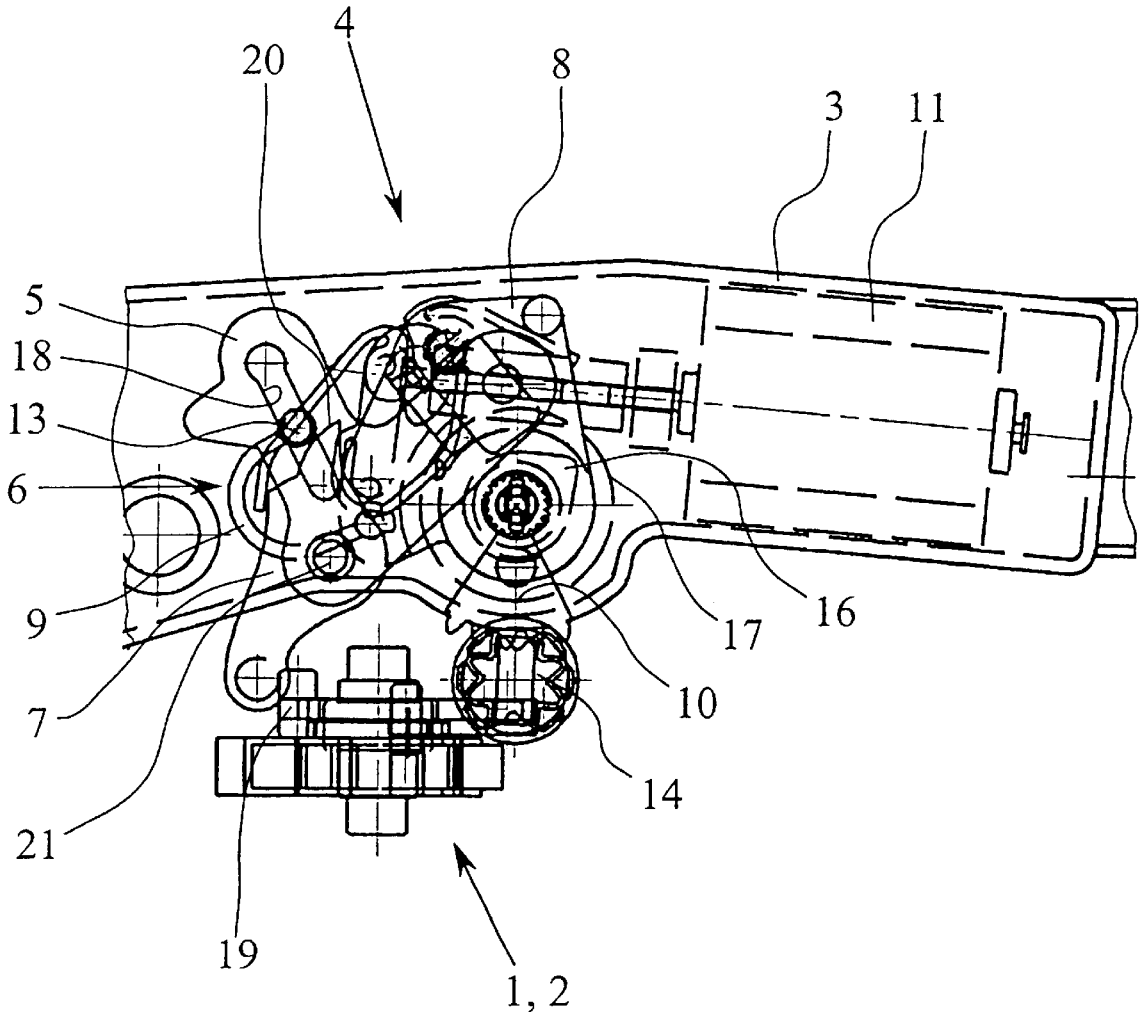
FIG. 3 shows the embodiment shown in FIG. 2, with the inside actuating lever being actuated, but the child safety turned off.

FIG. 2 shows how the inside actuating lever 5 is displaced when the inside door handle (not shown) is pulled. The coupling pin 13 is entrained without the spring mechanism 9 being tensioned. FIG. 3 shows how the displacement mechanism 8, in this embodiment the child safety lever, is displaced when, in the position from FIG. 2, the child safety is actuated, therefore the child safety is turned on. The child safety lever (displacement mechanism 8) has been pivoted counterclockwise from FIG. 2 to FIG. 3 by the mechanical rotation of the nut 14. Accordingly, this may also take place through the activation of the electric-motorized child safety drive 11. Since the actuation mechanism 5 (the inside actuating lever) is not in its actuated position because the inside door handle is being pulled, the coupling pin 13 of the coupling element 6 has retained its position although the coupling point 12 of the coupling element 6 has been displaced from FIG. 2 to FIG. 3. The distance has increased, and is captured by bending upward the arc-shaped section between the coupling point 12 and the coupling pin 13. The spring mechanism 9 which is formed by this section is pre-tensioned. The coupling pin 13 is pre-tensioned on the arc-shaped contact surface of the trigger mechanism 7.

Figure 4:
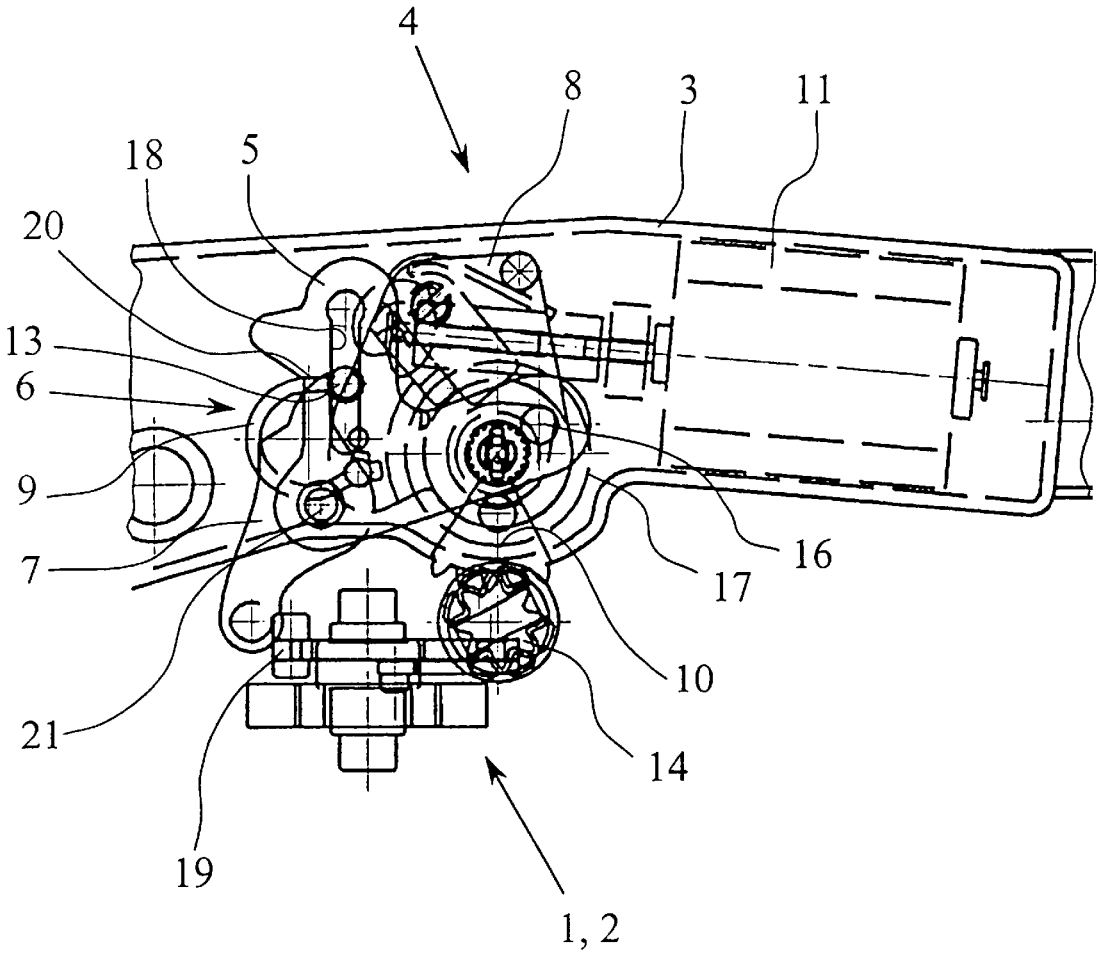
FIG. 4 shows the FIG. 3 embodiment after the return of the inside actuating lever into a base position.

If, at this point, the actuation mechanism 5 (the inside actuating lever) is released, the actuation mechanism 5 springs back in a clockwise direction under its own spring force from FIG. 3 to FIG. 4. The coupling pin 13 moves upward as the pretensioning of the spring mechanism 9 increases on the contact surface 20 of the trigger mechanism 7, passes the edge and then springs backward into the position shown in FIG. 4 by the action of the spring force of the spring mechanism 9 in the crank 18. As a result, the coupled position of the coupling element 6 is reached so that the child safety is turned off.

While the coupling pin 13 is movably guided in the crank 18 of the actuation mechanism 5, and thus, is entrained by the actuating mechanism 5 when pivoted about its pivot axis, other coupling systems with the corresponding result may be used. In this embodiment, it is preferred that the actuating mechanism 5 and the trigger mechanism 7 are pivotally mounted on the same pivot axis 21. In the child safety lever which is driven by a motor, the displacement mechanism 8 has the special advantages which are previously explained, however, microswitches can optionally be used.

What is claimed is:

1. A motor vehicle door lock comprising;

a lock latch;

a detent pawl for blocking said lock latch in a closed position; and a lock mechanism including:

a trigger mechanism for actuating said detent pawl;

an actuation mechanism for actuating said trigger mechanism;

a one piece coupling element for coupling said actuation mechanism to said detent pawl;

a displacement mechanism for moving said one piece coupling element from a coupled position into an uncoupled position when said actuation mechanism is not actuated and for moving said one piece coupling element from said uncoupled position into a storage position intermediate said uncoupled position and said coupled position when said actuation mechanism is actuated; and a spring mechanism for moving said one piece coupling element from said storage position into said coupling position when said displacement mechanism is not actuated;

wherein said on piece coupling element comprises a plastic spring lever having a fixed coupling point at one end, a coupling pin positioned at a distance away from said coupling point at another end, and a spring elastic section between the fixed coupling point and the coupling pin, said spring elastic section extending sideways relative to an axis defined by the coupling point and the coupling pin; wherein the spring mechanism is formed by said spring elastic section of the one piece coupling element so that the coupling pin is elastically deflectable relative to the coupling point, and in the coupled position, engages said trigger mechanism; and wherein said coupling pin is movably guided in an elongated slot of said actuation mechanism in direction away from the fixed coupling point by a contact surface of the trigger mechanism, said contact surface having an edge at which the coupling pin is release to spring back into the coupled position engaging said trigger mechanism.

2. The motor vehicle door lock as claimed in claim 1, wherein said actuation mechanism comprises an actuating lever which is actuated by a outside door handle; and wherein said displacement mechanism comprises a safety lever which is actuated by at least one of an inside door handle, an inside safety button and a central interlock drive.

3. The motor vehicle door lock as claimed in claim 1, wherein said actuation mechanism comprises an actuating lever which is actuated by an inside door handle and said displacement mechanism comprises an actuating lever which is actuated by the inside door handle.

* * * * *